United States Patent [19]

Gieske

[11] 4,080,898

[45] Mar. 28, 1978

[54] SPIRAL WRAPPED SHAPED CHARGE LINERS AND MUNITION UTILIZING SAME

[76] Inventor: Harry A. Gieske, 14704 Pebblestone Dr., Silver Spring, Md. 20904

[21] Appl. No.: 655,611

[22] Filed: Feb. 5, 1976

[51] Int. Cl.[2] ..... F42B 1/02

[52] U.S. Cl. ..... 102/24 HC; 102/56 SC

[58] Field of Search ..... 102/24 HC, 56 SC

[56] References Cited

U.S. PATENT DOCUMENTS

| | | | |
|---|---|---|---|
| 2,900,905 | 8/1959 | MacDougall | 102/24 HC |
| 3,252,418 | 5/1966 | Terrioux | 102/24 HC |

FOREIGN PATENT DOCUMENTS

| | | | |
|---|---|---|---|
| 1,259,377 | 3/1961 | France | 102/24 HC |

*Primary Examiner*—Verlin R. Pendegrass

[57] ABSTRACT

This invention relates to shaped charge liners and methods of their manfuacture for use in shaped charge explosives and munitions as used in military, industrial and rescue operations. In a more specific aspect the invention relates to an improvement in shaped charge liners employing spirally wound wire or rod to form the desired geometrical shape of the liner.

In this invention, shaped charge liners of a desired shape are fabricated by sequentially winding wire or rod about a preformed mandrel, with the wire or rod being held in proper position through the use of adhesives or solders.

2 Claims, 6 Drawing Figures

SPIRAL WRAPPED SHAPED CHARGE LINERS AND MUNITION UTILIZING SAME

BACKGROUND OF THE INVENTION

1. Field of the Invention

This invention relates to shaped charge liners, methods of their manufacture, and their use in shaped charge explosives and munitions.

2. Description of Prior Art

There exists today a class of explosives and munitions which are used to produce holes or indentations in a surface or target against which the explosive or munition is directed. These explosives are known as shaped charges and typically can be utilized to penetrate the armor plate of military vehicles such as tanks and ships, to penetrate concrete fortifications, to aid in the penetration of rock formations during mining and excavation operations, or to provide quick access openings during emergency rescue operations. The art of shaped charge explosives is some seventy years old, is detailed in foreign and domestic reports, and is indicated in shaped charge munitions made and used by many nations. Current art in shaped charge explosive design is exemplified by a cylindrically shaped explosive compound, one end of which has a conically shaped cavity, the other end of which has a detonator, and the outer cylindrical surface of which is confined by a cylindrical metal shell. Into the conical cavity is inserted a copper or aluminum cone called the liner of the shaped charge. Current practice in the fabrication of the metallic shaped charge liner is the use of coining and machining processes to achieve liners of the desired shape and dimension.

To facilitate understanding of the present invention it is helpful to describe the phenomena associated with shaped charge explosive detonation. Upon activation of the detonator, a detonation wave propagates through the explosive compound. The resulting compression wave, upon reaching the apex of the conical liner compresses and starts to move the material of the liner, first in the region of the apex, and then progressively the rest of the liner as the compression wave reaches the bottom of the conical liner. During the process of compression and resulting collapse of the liner, a jet, having high speed, is made of a portion of the liner material. It is the high speed jet material which is associated with target penetration. Not all of the liner material is contained in the high speed jet. Some of the liner material follows behind the jet at a lower speed.

One of the major objectives in shaped charge explosive design is to obtain as great a penetration depth and hole volume in the target as can be achieved for a given weight and diameter of explosive charge. Experience shows that performance of shaped charge explosives is determined in part by the shape, density and ductility of the liner material. Experiments show that performance of currently used shaped charge explosives is also directly related to the maintaining of close demensional tolerances on the liner, particularly the wall thickness of the liner.

The theory of shaped charge penetration shows that to improve the performance of shaped charges, it is required to use liner materials of high density, to increase the speed of the jet formed by the shaped charge, and to increase the length of the continuous portion of the shaped charge jet. Theoretically, it is desirable to have a liner material having a density greater than that of the target. For typical military targets the jet should consist of materials of high density such as steel or tungsten.

SUMMARY OF THE INVENTION

Accordingly, a primary objective of the present invention is to provide shaped charge liners capable of improving the performance of shaped charge explosives. Another object of the invention is to provide a unique liner configuration which facilitates the fabrication of shaped charge liners. Another object of the invention is the fabrication of shaped charge liners having densities equivalent to that of armor steels and of tungsten. Still another object of the invention is to provide shaped charge liners capable of producing higher speed and longer continuous shaped charge jets. An additional objective of the present invention is to provide a means of making shaped charge explosives which are smaller but equal in performance to currently available shaped charge explosives.

BRIEF DESCRIPTION OF THE DRAWINGS

The present invention will next be described with reference to the accompanying drawings in which.

DETAILED DESCRIPTION OF THE INVENTION

Figure 1:
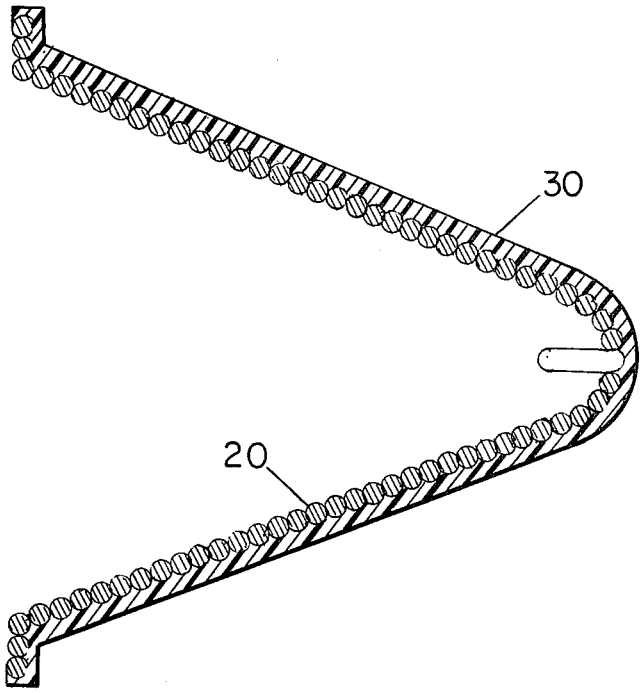
FIG. 1 is a sectional view of a right circular conical liner constructed according to the present invention.
Figure 2:
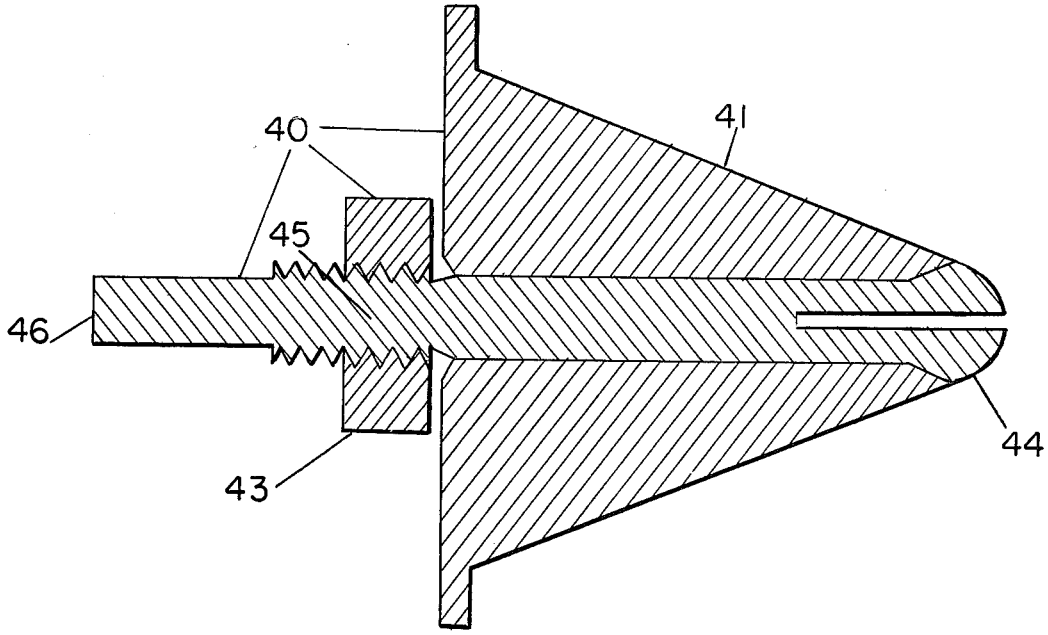
FIG. 2 is a view of a right circular conically shaped mandrel for use in fabricating conical liners according to the present invention.

Referring to FIG. 1, the present invention consists of liners formed by sequentially winding a rod or wire of suitable material, (for example copper, aluminum, steel or tungsten), in such a way as to make a right circular conic with the terminus of the wire or rod at the apex being folded into the interior of the conic. The interior terminus of the wire or rod serves as the holding point of the liner during manufacture of the liner, and as the leading portion of the penetrating jet when the liner is used in a shaped charge munition. In FIG. 1, the rod or wire 20 is held in place by an adhesive 30, having sufficient strength to hold the spirally wrapped wire in rigid juxta-position after the mandrel is removed from within. The adhesive 30 is either a thermal setting plastic, a metal based solder, or a cement chosen for curing and strength properties according to the mechanical environment expected to be encountered by the shaped charge liner prior to the detonation of the explosive. Typical environments to be considered are the shock and vibration associated with gun launched projectiles and the transportation and handling of commercially available explosives. In FIG. 1, the wire or rod 20 is depicted as having a circular cross-section, as might be supplied by commercial producers of wire and rod. FIG. 2 shows the mandrel assembly 40 which consists of three components of which 41 is the mandrel body, of which 42 is the mandrel stem, and 43 is the mandrel assembly retaining nut. The mandrel body is a body of revolution which has been shaped to the inside geometry of the desired liner shape. The mandrel stem is configured to have contracting jaws to grip the wire inserted into end 44 and to have a threaded section 45 to accomodate the retaining nut 43. The retaining nut holds the mandrel body 41 and mandrel stem 42 securely together forcing the jaws of 42 to close about the liner wire. End 46 is configured to allow the mandrel assemble to be inserted in a lathe or other controllable turning machine. In making a liner, wire or rod is inserted into the jaws of the mandrel stem 42, and the mandrel retaining nut 43 is adjusted until the jaws securely hold the wire or rod. Then the wire or rod is bent and wound on to the mandrel in a closed spiral on the surface of the mandrel body. An adhesive is applied to hold the windings in place, before removal of the spiral windings from the mandrel body.

Figure 3:
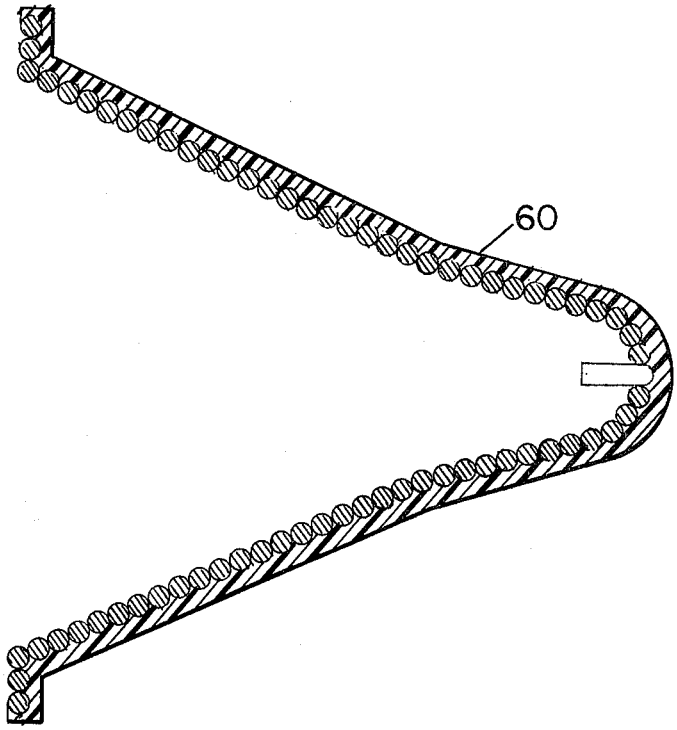
FIG. 3 is a view of a compound angle conically shaped liner constructed according to the present invention.
Figure 4:
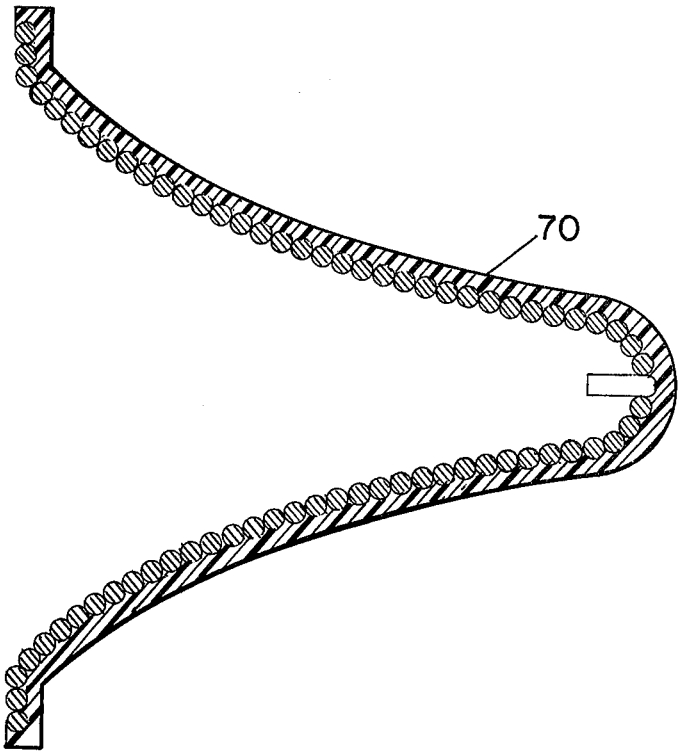
FIG. 4 is a sectional view of a fluted liner constructed according to the present invention.

FIG. 3 presents a sectional view of a liner 60 having two different cone angles and an interior open terminus. For this liner a mandrel body, similar to that in FIG. 2 but having the double conical shape, is used. Similarly FIG. 4 shows a fluted liner 70 having a continuously variable cone angle with an interior apex terminus. The shape of liner 70 is achieved by wrapping the liner material about a mandrel with the fluted shape.

Figure 5:
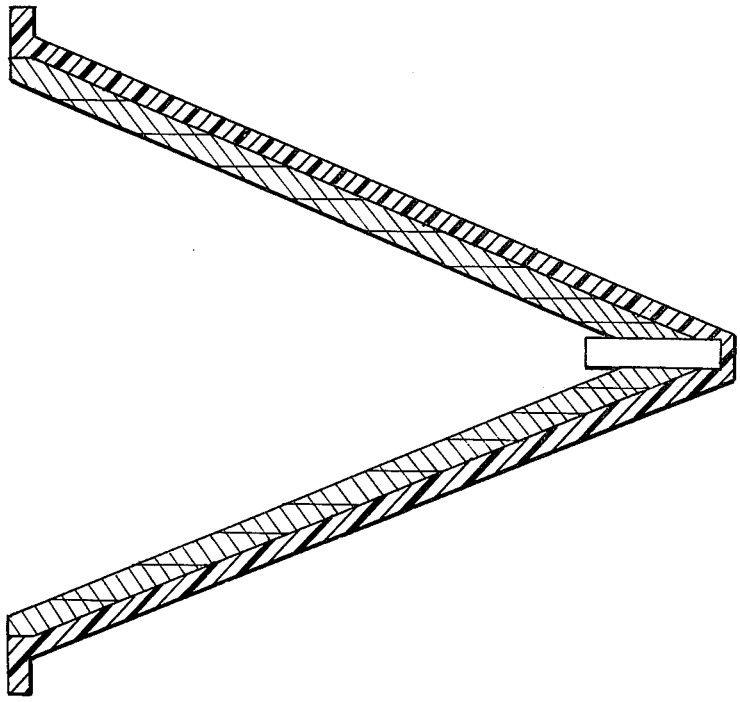
FIG. 5 is a sectional view of a liner constructed of wire having a non-circular cross-section.

FIG. 5 shows a liner made using a mandrel similar to that of FIG. 2, but using wire having a parallelogramatic cross-section, or flattened ribbon cross-section and having an interior apex terminus.

Figure 6:
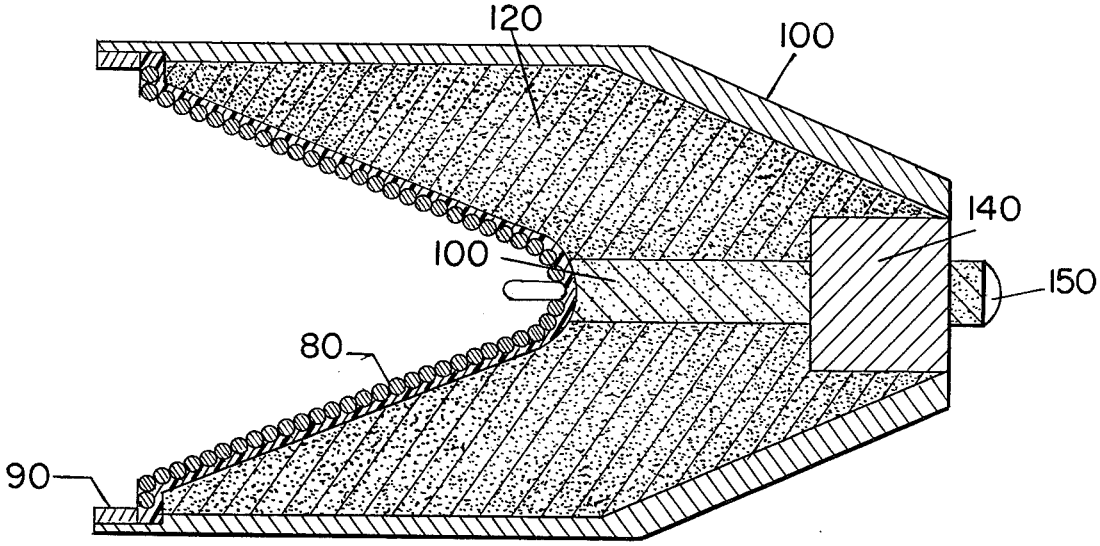
FIG. 6 is a cross sectional view of a shaped charge explosive using the present invention.

In FIG. 6 there is shown a sectional view of a shaped charge munition utilizing a spiral wrapped liner. In this figure the liner 80 is held by retaining ring 90 in rigid relationship to the body 100. The explosive fill of the munition contains two coaxial segments having differing detonation wave prpagation velocities. Explosive fill segment 110 is chosen to have a detonation wave velocity higher than explosive fill segment 120 and is in contact with the apex. In this way the apex of the cone is caused to be moved earlier than the rest of the liner material when the munition is detonated and the interior terminus serves as the leading portion of the penetrating jet. This action aids in assuring start of the internal unwrapping of the spiral wrapped liner at the apex before the cone is caused to collapse to the axis of the cone. The booster charge 140 and the detonator 150 are standard components used in initiating high explosives.

Advantages of the spiral wrapped liner with interior apex terminus will next be described. As indicated earlier, the energy of the explosive is used to collapse the liner material. Using the spiral wrapped liner requires less energy to deform the liner since energy to shear adjacent elements of the cone material is not required. Instead only a minimum of energy is required to overcome the strength of the adhesive, thus allowing each layer of the spiral to be successively pushed to the cone axis and propelled out of the shaped charge as the jet material.

Use of the spiral wrapped liner also enhances the length of the high speed jet thereby aiding penetration performance. This results from the capability of using higher strength materials such as steel and tungsten. Further, control of dimensional tolerances is achieved through use of dies to make the wire and rod, rather than the coining and machining operations on each liner. Dimensional control is transferred to the one time fabrication of the mandrel rather than the fabrication of each individual liner.

Use of the spiral wrapped liner concept and the mandrel method of fabrication facilitates manufacture of a large set of geometry options for shaped charge liner configurations. The geometry of a spiral wrapped liner is determined by the mandrel used. By changing mandrel shapes, a wide variety of cone angles, or concave and convex figures of revolution may be formed. The interior apex terminus is the means of facilitating the mandrel method of fabrication.

It will be apparent that the embodiments shown are only exemplary and that various midifications can be made in fabrication and arrangement within the scope of the invention as defined in the appended claim. Therefore, I wish it to be understood that I do not desire to be limited to the exact details of construction or geometrics shown and described, for obvious modifications can be made by a person skilled in the art.

I claim:

1. A shaped charge liner comprising a spirally wrapped wire or rod in the form of a concave shell having an apex and a base with one end of said wire or rod projecting from said apex towards said base to act as a means for holding the liner during manufacture and for forming a leading portion of a shaped charge jet when utilized in a shaped charge munition.

2. A shaped charge liner as in claim 1 in combination with a shaped charge munition comprising an inner explosive segment in contact with the liner apex and surrounded by an outer explosive segment, the explosive segments being coaxial and the inner segment having a higher detonation wave propagation speed than the outer segment.

* * * * *